US008870490B2

(12) United States Patent
Gumbley

(10) Patent No.: US 8,870,490 B2
(45) Date of Patent: Oct. 28, 2014

(54) ADJUSTABLE SUPPORTS FOR ACCESS HATCH FRAMES

(75) Inventor: Neil Watson Gumbley, Rotorua (NZ)

(73) Assignee: Opus International Consultants Limited, Wellington (NZ)

( * ) Notice: Subject to any disclaimer, the term of this patent is extended or adjusted under 35 U.S.C. 154(b) by 0 days.

(21) Appl. No.: 13/983,427

(22) PCT Filed: Feb. 3, 2012

(86) PCT No.: PCT/NZ2012/000009

§ 371 (c)(1),
(2), (4) Date: Oct. 17, 2013

(87) PCT Pub. No.: WO2012/105856

PCT Pub. Date: Aug. 9, 2012

(65) Prior Publication Data

US 2014/0026491 A1 Jan. 30, 2014

(30) Foreign Application Priority Data

Feb. 4, 2011 (NZ) ..... 590938

(51) Int. Cl.
*E02D 29/14* (2006.01)

(52) U.S. Cl.
CPC ..... *E02D 29/14* (2013.01)
USPC ..... 404/26

(58) Field of Classification Search
USPC ..... 404/26
IPC ..... E02D 29/14
See application file for complete search history.

(56) References Cited

U.S. PATENT DOCUMENTS

| | | | | |
|---|---|---|---|---|
| 1,076,386 | A | 10/1913 | O'Day | |
| 1,639,495 | A | 8/1927 | Frame | |
| 3,263,579 | A | 8/1966 | Dorris | |
| 3,392,640 | A | 7/1968 | Zeile | |
| 3,773,428 | A | 11/1973 | Bowman | |
| 3,858,998 | A | 1/1975 | Larsson et al. | |
| 3,930,739 | A | 1/1976 | Larsson et al. | |
| 4,149,816 | A | 4/1979 | Piso | |
| 4,273,467 | A | 6/1981 | Cronk | |
| 4,925,337 | A | 5/1990 | Spiess et al. | |
| 5,211,504 | A * | 5/1993 | Trudel | 404/26 |
| 5,344,253 | A | 9/1994 | Sacchetti | |
| 5,360,131 | A | 11/1994 | Phillipps et al. | |

(Continued)

FOREIGN PATENT DOCUMENTS

| | | |
|---|---|---|
| AT | 409643 | 2/2002 |
| AT | 397116 | 6/2008 |

(Continued)

*Primary Examiner* — Gary Hartmann
(74) *Attorney, Agent, or Firm* — Larson & Anderson, LLC

(57) ABSTRACT

The invention disclosed is an adjustable support adapted to support an access hatch frame for access to a sub-surface chamber or the like. The support has a lower frame member that at least in part defines a first aperture, the first aperture having or defining a first plane, the lower frame member having at least one upper interface surface. A similar upper frame is present that defines a second aperture, a second plane, and a lower interface surface. Upper frame member also has number of height adjustable mount points. The upper and lower interface surfaces define an interface plane. Rotation of the upper frame member, relative to said lower frame member on the interface plane, adjusts the relative angle of the two.

20 Claims, 7 Drawing Sheets

(56) References Cited

U.S. PATENT DOCUMENTS

| | | | | |
|---|---|---|---|---|
| 5,362,174 | A * | 11/1994 | Yang | 404/25 |
| 5,513,926 | A | 5/1996 | Prescott | |
| 5,564,855 | A | 10/1996 | Anderson | |
| 5,723,192 | A | 3/1998 | Jonasz | |
| 5,956,905 | A | 9/1999 | Wiedrich | |
| 5,974,741 | A | 11/1999 | Fukuhara | |
| 6,179,518 | B1 | 1/2001 | Suatac | |
| 6,196,760 | B1 | 3/2001 | Sinclair | |
| 6,371,687 | B1 | 4/2002 | Heintz et al. | |
| 6,457,901 | B1 | 10/2002 | Sondrup | |
| 6,520,713 | B2 | 2/2003 | Sondrup | |
| 6,524,026 | B2 * | 2/2003 | Sondrup | 404/26 |
| 6,695,526 | B2 | 2/2004 | Sondrup | |
| 6,799,920 | B2 * | 10/2004 | Sondrup | 404/26 |
| 6,811,350 | B2 | 11/2004 | Nadasde | |
| 6,953,302 | B1 | 10/2005 | Kochling | |
| 6,955,499 | B2 * | 10/2005 | Sondrup | 404/26 |
| 6,997,639 | B2 * | 2/2006 | Nadasde | 404/26 |
| 7,726,903 | B2 | 6/2010 | Vrondran | |
| 7,832,958 | B2 | 11/2010 | Veldboom | |
| 7,905,679 | B2 | 3/2011 | Vrondran et al. | |
| 8,206,058 | B2 | 6/2012 | Vrondran et al. | |
| 8,382,392 | B2 * | 2/2013 | Liao | 404/26 |
| 2002/0136605 | A1 | 9/2002 | Sondrup | |
| 2004/0013466 | A1 | 1/2004 | Sondrup | |
| 2004/0120762 | A1 | 6/2004 | Sondrup | |
| 2005/0058505 | A1 | 3/2005 | Nadasde | |

FOREIGN PATENT DOCUMENTS

| | | |
|---|---|---|
| CA | 2299838 | 8/2000 |
| CN | 2121484 | 11/1992 |
| DE | 1942981 | 3/1971 |
| DE | 3123373 | 5/1983 |
| DE | 3413823 | 10/1985 |
| DE | 19826693 | 12/1999 |
| DE | 10352582 | 6/2005 |
| EP | 0485649 | 5/1992 |
| EP | 0950766 | 10/1998 |
| EP | 1811093 | 1/2007 |
| GB | 1249860 | 10/1971 |
| GB | 2175334 | 11/1986 |
| IL | 101170 | 6/1994 |
| JP | 62021933 | 1/1987 |
| JP | 5263430 | 10/1993 |
| JP | 8113956 | 5/1996 |
| JP | 9177106 | 7/1997 |
| JP | 9324438 | 12/1997 |
| JP | 11152765 | 6/1999 |
| JP | 11293694 | 10/1999 |
| JP | 2009-287159 | 12/2009 |
| KR | 10 0880802 | 1/2009 |
| KR | 10-2009-0101066 | 9/2009 |
| NZ | 328354 | 7/1997 |
| NZ | 329263 | 10/1998 |
| NZ | 518648 | 9/2000 |
| NZ | 526572 | 6/2004 |
| NZ | 548488 | 7/2007 |
| WO | 98/35107 | 8/1998 |
| WO | 02/18710 | 3/2002 |
| WO | 2004/031491 | 4/2004 |
| WO | 2006/082569 | 8/2006 |

* cited by examiner

ADJUSTABLE SUPPORTS FOR ACCESS HATCH FRAMES

CROSS-REFERENCE TO RELATED CASES

The present application is a national stage application of PCT/NZ2012/000009 filed on Feb. 3, 2012, which claims priority to New Zealand patent application no. 590938 filed on Feb. 4, 2011, all of which are incorporated herein by reference for all purposes.

TECHNICAL FIELD OF THE INVENTION

The present invention relates to improvements in methods and apparatus for adjustable supports for access hatch frames. In particular, though not solely, the present invention is directed to an adjustable support for an access hatch frame, for example as an access to a sub-surface chamber or the like, the adjustable support having adjustable height and angle.

BACKGROUND OF THE INVENTION

There is often a requirement to provide an in-ground or, at least in part, sub-surface chamber for example to house or allow access to utilities such as electricity, water, sewage, telecommunications, gas and the like. Such chambers may also be needed for other applications where a chamber is required below a surface, whether in ground or otherwise.

The chambers provide a convenient way to contain what is required in the chamber in a way that is effectively taking up space that is otherwise not used. In most situations a sub-surface location is also convenient because of access and proximity to the utility or similar the chamber is to service or contain.

Typically such chambers are in or below the surface of a roadway, footpath or similar location. However, such chambers may also be, at least in part, below a floor or other surface of a construction. For example, they may provide access to a subfloor chamber or void on a floor or otherwise above the ground.

The chambers are typically entirely enclosed except for an aperture which is normally dosed by a removable and or lockable access hatch. Such access hatches are referred to variously as manholes, utility hatches, maintenance hatches, inspection hatches and access hatches. The chambers are referred to variously as manholes, utility holes or vaults, maintenance holes, cable chambers, inspection chambers, access chambers or confined spaces. Normally the upper surfaces of the access hatch and its surrounding support frame lie substantially flush with the upper surface of the area within which they are located, for example a footpath, floor roadway or similar.

Typically such chambers when they are placed cannot, or are not, placed with a great deal of accuracy, particularly for the access hatch into the chamber. This is either because of the construction methods used, the weight of the chamber or degree of skill in placing it, or because the exact location of the access hatch is not known, or the final form of the ground surrounding the access hatch and its cover is not known. For example, the final surface height below which the sub-surface chamber is located may be of different height or slope.

There may be a need to change the height and or angle the upper surfaces of the access hatch present after they are installed. This may occur for example when there is a need to re-surface the surrounding surfaces, for example when road works occur.

In this specification where reference has been made to patent specifications, other external documents, or other sources of information, this is generally for the purpose of providing a context for discussing the features of the invention. Unless specifically stated otherwise, reference to such external documents is not to be construed as an admission that such documents, or such sources of information, in any jurisdiction, are prior art, or form part of the common general knowledge in the art.

It is therefore an object of the present invention to provide an improved adjustable access hatch frame, or to overcome the above shortcomings or address the above desiderata, or to at least provide the public with a useful choice.

BRIEF DESCRIPTION OF THE INVENTION

In a first aspect the present invention may be said to consist in an adjustable support adapted to support an access hatch frame for access to a sub-surface chamber or the like, comprising or including:

- a lower frame member that at least in part defines a first aperture, said first aperture having or defining a major plane ("first plane"), said lower frame member having at least one upper interface surface;
- an upper frame member that at least in part defines a second aperture, said second aperture also having or defining a major plane ("second plane"), said upper frame member also having, at least one lower interface surface, and a plurality of height adjustable mount points; and
- wherein said at least one upper interface surface and said at least one lower interface surface define an interface ("planar interface"), located on or parallel to a plane ("interface plane"), which plane is not necessarily parallel to either of said first or second planes, wherein said lower interface surface and said upper interface surface are bevelled to aid engagement thereof, such that rotation of said upper frame member relative to said lower frame member about or on said planar interface varies the relative angle of said first plane to said second plane, said relative rotation and said height adjustable mount points allowing adjustment of said relative angle and height, relative to said upper frame member and said lower frame member, of a third member adapted to be mounted from said upper frame member via said plurality of height adjustable mount points.

Preferably said third member is an access hatch frame that at least in part defines a third aperture.

Preferably said access hatch frame is adapted to receive a hatch cover that at least part covers said third aperture.

Preferably said upper frame member, lower frame member, and access hatch frame via said first aperture, second aperture and third aperture define an access passage to said sub-surface chamber or the like when mounted thereto and said hatch cover at least in part doses off said access passage.

Preferably said sub-surface chamber or the like is substantially sealed from access by said adjustable support, access hatch frame and said hatch cover (when in place).

Preferably said plurality of height adjustable mount points are adjustable members that extend from said upper frame member to said access hatch frame.

Preferably said adjustable members are infinitely adjustable over the height they mount said access hatch frame from said upper frame member.

Alternatively said adjustable members are step-wise adjustable over the height they mount said access hatch frame from said upper frame member.

Preferably said adjustable members are threaded adjustable members.

Alternatively said adjustable members are stepped adjustable members.

Preferably said relative rotation is capable of being releasably locked once said relative angle between said first plane and said second plane is chosen.

Preferably said releasable locking is via a releasable engagement between said upper frame member and said lower frame member.

Preferably said relative rotation is capable of being locked once said relative angle between said first plane and said second plane is established.

Preferably said locking is via a setting compound, such as for example a cementitious, epoxy or other chemical reaction based compound.

Preferably any gap between lower surfaces of said third member and said sub-surface chamber are filled or adapted to be filled or covered to present a substantially continuous access passage to said sub-surface chamber or the like from said access hatch frame.

Preferably any said gap present is at least in part covered by a first skirt that depends from a lower periphery of said access hatch frame at least down to said upper frame member.

Preferably said gap is at least in part covered by a second skirt that from an upper periphery of said upper frame member at least up to said access hatch frame.

Preferably said gap is shuttered off as part of the construction process and fill or other material that surrounds said adjustable support covers said gap.

Preferably said upper frame member and said lower frame member are substantially circular in plan view.

Preferably said planar interface is substantially circular at least on said interface plane.

Preferably said lower frame member sits at least in part into a mating recess on an upper surface of said sub-surface chamber or the like.

Preferably said access hatch frame and or hatch cover (when in place) substantially define an uppermost surface that when said sub-surface chamber, adjustable support, access hatch frame, and hatch cover are installed is substantially flush or continuous with a surface below which said sub-surface chamber is mounted.

Preferably said adjustable support is substantially constructed from a cementitious or the like, metal, alloy or the like material.

Preferably said planar interface has an interlocking of said at least one upper interface surface and said at least one lower interface surface that allows relative rotation of the two but not translation.

Preferably said interlocking is provided by a third skirt that depends from said at least one upper interface surface that is complimentary to a fourth skirt that depends from said at least one lower interface surface.

Preferably said third skirt and or said fourth skirt are flared or tapered at least on upwardly angled surfaces at or near where they engage.

In another aspect the present invention consists in an adjustable support adapted to support an access hatch frame for a sub-surface chamber or the like, comprising or including:

a lower frame member with a lower mounting surface, and an angled upper surface, said lower frame member defining at least in part a first aperture;

an upper frame member, defining at least in part a second aperture, said upper frame member having an upper mounting surface and an angled lower surface for engagement with said angled upper surface;

said angled lower surface and said angled upper surface are bevelled to aid engagement thereof and when engaged defining an angled contact zone, wherein relative rotation of said upper frame member relative to said lower frame member about or on said angled contact zone causes said upper mounting surface to vary its angle relative to said lower mounting surface;

depending from said upper frame member, in a direction away from said lower frame member, there are a plurality of height adjustment mount points; and wherein said relative rotation and said height adjustment mount points allow for adjustment of said angle and height of a access hatch frame capable of being mounted therefrom.

Preferably said upper frame member and said lower frame member when engaged have at least partial overlap of said first aperture and said second aperture.

Preferably said first aperture and said second aperture are substantially concentric.

Preferably said adjustable support once set at the desired said angle is locked into position.

Preferably said locking is with mortar or similar curing compound.

Preferably there is a keying of said access hatch frame and upper frame member by a skirt that depends down from said access hatch frame or vice versa.

Preferably said lower frame member has a lower mounting surface adapted to engage with or mount to a surface of said sub-surface chamber or the like.

Preferably in use said adjustable support lies substantially above and/or on said sub-surface chamber of the like.

Preferably said upper frame member is adapted to align concentrically with said lower frame member.

In a further aspect the present invention consists in an adjustable support adapted to support an access hatch frame for a sub-surface chamber or the like, comprising or including:

an upper frame member;

a lower frame member; and wherein there is an angled interface, which is also bevelled to aid engagement thereof between mating surfaces thereof, such that relative rotation of said upper frame member to said lower frame member varies a relative angle of each, and wherein there is a plurality of mount points on said upper frame member for adjustable mounting of a third member therefrom.

In yet a further aspect still the present invention consists in an adjustable support adapted for an access hatch frame for a sub-surface chamber, comprising or including:

a lower frame member having a lower mounting surface and defining at least in part an aperture;

an upper frame member, also at least in part defining said aperture, said upper frame member having, an upper mounting surface, and a plurality of mounting points adapted to provide a height adjustable mounting therefrom; and wherein there is an angled interface between said lower frame member and said upper frame member, defined at least in part by an upper interface surface of said lower frame member and a lower interface surface of said upper frame member, wherein said lower interface surface and said upper surface are bevelled to aid engagement thereof, such that relative rotation about or on said angled interface of said upper frame member to said lower frame member results in a change of angle at least of said lower mounting surface relative to said upper mounting surface, and said plurality of mounting points provide a height adjustable mounting for an access hatch frame adapted to be mounted therefrom.

Preferably said angled interface is continuous and infinitely adjustable.

Preferably said upper interface surface and said lower interface surface are parallel to each other and lie on or parallel to an interface plane whose orthogonal is at an angle to a major plane of said aperture.

In yet still another aspect the present invention consists in an adjustable access hatch frame for access to a sub-surface chamber or the like, comprising or including:

a lower frame member that at least in part defines a first aperture, said first aperture having or defining a major plane ("first plane"), said lower frame member having at least one upper interface surface;

an upper frame member that at least in part defines a second aperture, said first aperture also having or defining a major plane ("second plane"), said upper frame member also having, at least one lower interface surface, and a plurality of height adjustable mount points;

wherein said at least one upper interface surface and said at least one lower interface surface define an interface ("planar interface"), located on or parallel to a plane ("interface plane"), which plane is not parallel to either of said first or second planes, wherein said lower interface surface and said upper interface surface are bevelled to aid engagement thereof, such that rotation of said upper frame member relative to said lower frame member about or on said planar interface vanes the relative angle of said first plane to said second plane;

an access hatch frame adapted to mount from said upper frame member via said plurality of height adjustable mount points; and wherein said relative rotation and said height adjustable mount points allow adjustment of said relative angle and height of said access hatch frame, relative to said upper frame member and said lower frame member.

In a further aspect still the present invention consists in a method of providing an adjustable support for access hatch frame for a sub-surface chamber or the like, comprising or including the steps of:

providing a lower frame member that at least in part defines a first aperture, said first aperture having or defining a major plane ("first plane"), said lower frame member having at least one upper interface surface;

providing an upper frame member that at least in part defines a second aperture, said second aperture also having or defining a major plane ("second plane"), said upper frame member also having, at least one lower interface surface, and a plurality of height adjustable mount points, wherein said at least one upper interface surface and said at least one lower interface surface define an interface ("planar interface"), located on or parallel to a plane ("interface plane"), which plane is not parallel to either of said first or second planes; wherein said lower interface surface and said upper interface surface are bevelled to aid engagement thereof;

rotating said upper frame member relative to said lower frame member, whether in situ or not, about or on said planar interface to vary the relative angle of said first plane to said second plane;

adjusting said plurality of mount points, whether in situ or not, to provide a desired height; and wherein said relative rotation and adjusting said height adjustable mount points allowing adjustment of said relative angle and height, relative to said upper frame member and said lower frame member, of a third member adapted to be mounted from said upper frame member via said plurality of height adjustable mount points.

In yet still another aspect the present invention consists in a method of installing an adjustable support for an access hatch frame for a sub-surface chamber or the like, comprising or including the steps of, Locating a lower frame member onto a sub-surface chamber or the like, said lower frame member at least in part defining a first aperture, said first aperture having or defining a major plane ("first plane"), said lower frame member having at least one upper interface surface;

Locating an upper frame member via at least one lower interface surface thereof onto said at least one upper interface surface, said upper frame member at least in part defining a second aperture, said second aperture also having or defining a major plane ("second plane"), said at least one upper interface surface and said at least one lower interface surface defining an interface ("planar interface"), located on or parallel to a plane ("interface plane"), which plane is not parallel to either of said first or second planes, wherein said lower interface surface and said upper interface surface are bevelled to aid engagement thereof, Rotating said upper frame member relative to said lower frame member on said interface plane as necessary to adjust the relative angle of said upper frame member to said lower frame member, Marking the relative positions of said upper frame member to said lower frame member via an indicia or indices on one of both of said upper frame member and said lower frame member, Mounting a third member off said upper frame member via a plurality of height adjustable mounts between said third member and said upper frame member, to thereby provide said third member with adjustable relative angle and height from said sub-surface chamber or the like to match a surface angle and height below which said sub-surface chamber or the like is, or is to be, located.

Preferably said upper frame member, lower frame member, and third member are then removed for any final preparation of said sub-surface chamber or the like or surrounding ground, prior to relocation in situ on said sub-surface chamber of the like.

Preferably a locking compound is located or locatable between said upper frame member and said lower frame member.

Preferably said third member is an access hatch frame.

Preferably fill is located about said upper frame member, lower frame member and said third member to produce said surface below which said sub-surface chamber of the like is located.

In still yet a further aspect the present invention consists in a kit of parts to provide an adjustable support for an access hatch frame for a sub-surface chamber or the like, comprising or including:

an adjustable support comprising or including:

a lower frame member that at least in part defines a first aperture, said first aperture having or defining a major plane ("first plane"), said lower frame member having at least one upper interface surface;

an upper frame member that at least in part defines a second aperture, said second aperture also having or defining a major plane ("second plane"), said upper frame member also having, at least one lower interface surface, and a plurality of height adjustable mount points; and wherein said at least one upper interface surface and said at least one lower interface surface define an interface ("planar interface", located on or parallel to a plane ("interface plane"), which plane is not parallel to either of said first or second planes, wherein said lower interface surface and said upper interface surface are bevelled to aid engagement thereof, such that rotation of said upper frame member relative to said lower frame member about or on said planar interface varies the relative angle of said first plane to said second plane, said relative rotation and said height adjustable mount points allowing adjustment of said relative angle and height, relative to said upper frame member and said second frame member, of a third member adapted to be mounted from said upper frame member via said plurality of height adjustable mount points.

Preferably there is included an access hatch frame as said third member.

Preferably there is included a hatch cover to at least in part dose said access hatch frame.

Preferably there is including a locking material to lock said upper frame member to said lower frame member.

In yet another aspect the present invention consists in an adjustable support for an access hatch frame as herein described with reference to any one or more of the accompanying drawings.

In yet another aspect the present invention consists in an adjustable access hatch frame as herein described with reference to any one or more of the accompanying drawings.

In yet another aspect the present invention consists in a method of providing an adjustable support for an access hatch frame as herein described with reference to any one or more of the accompanying drawings.

In yet another aspect the present invention consists in a kit of parts as herein described with reference to any one or more of the accompanying drawings.

As used herein the term "and/or" means "and" or "or", or both.

As used herein "(s)" following a noun means the plural and/or singular forms of the noun. The term "comprising" as used in this specification means "consisting at least in part of". When interpreting statements in this specification which include that term, the features, prefaced by that term in each statement, all need to be present, but other features can also be present. Related terms such as "comprise" and "comprised" are to be interpreted in the same manner.

It is intended that reference to a range of numbers disclosed herein (for example, 1 to 10) also incorporates reference to all rational numbers within that range (for example, 1, 1.1, 2, 3, 3.9, 4, 5, 6, 6.5, 7, 8, 9 and 10) and also any range of rational numbers within that range (for example, 2 to 8, 1.5 to 5.5 and 3.1 to 4.7).

The entire disclosures of all applications, patents and publications, cited above and below, if any, are hereby incorporated by reference.

To those skilled in the art to which the invention relates, many changes in construction and widely differing embodiments and application of the invention will suggest themselves without departing from the scope of the invention as defined in the appended claims. The disclosures and the descriptions herein are purely illustrative and are not intended to be in any sense limiting.

Other aspects of the invention may become apparent from the following description which is given by way of example only and with reference to the accompanying drawings.

BRIEF DESCRIPTION OF THE DRAWINGS

Preferred forms of the present invention will now be described with reference to the accompanying drawings in which:

FIG. 1: is an isometric exploded view of the present invention including an access hatch frame, cover and part of a sub-surface chamber or the like;

DETAILED DESCRIPTION OF THE INVENTION

Figure 1:
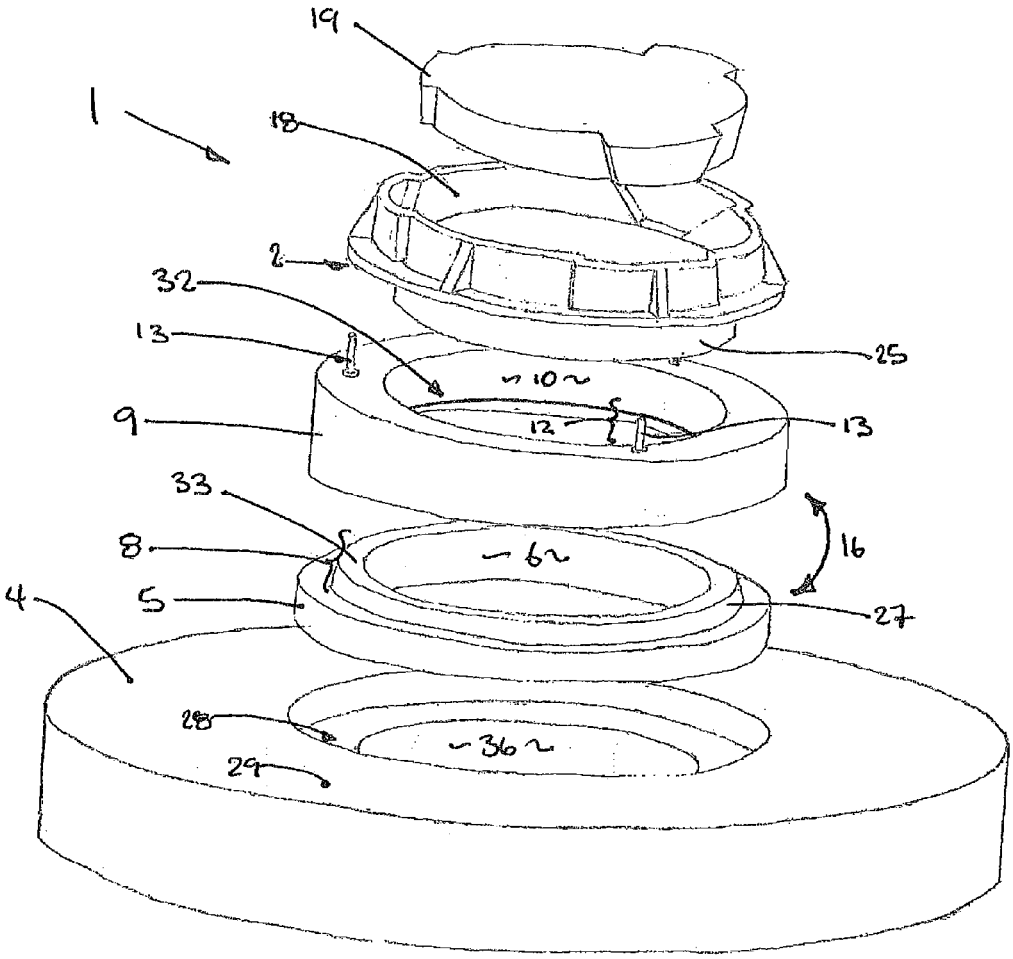

Preferred embodiments will now be described with reference to FIG. 1 through FIG. 8. The invention provides a system of bevelled interlocking concrete rings (lower frame member 5 and upper frame member 9), with an integrated height adjustment control to enable, for example cast iron manhole surface covers to be set exactly, and to match, the height and crossfall of, for example, a pavement or other ground surface 31 then are set into.

The term height refers to the relative height of the ground surface 31 of the pavement above the subsurface chamber 4 or the like. Crossfall is the term that defines the angle of that surface 31 relative to either the subsurface chamber 4 or the horizontal. Crossfall is important for several reasons including runoff of water from the ground surface 31 for example when in a reading situation.

The component design provides a method whereby there is full surface to surface contact between each of the lower frame member 6 and upper frame member 9. In one form of the invention the lower frame member 5 sits within a recess set into the top of the sub-surface chamber 4, and the access hatch frame 2 (for example a cast iron surface cover frame) has a shear key, skirt, or similar that fits inside the upper frame member 9. The result is an assembly that is locked together, optionally with a locking compound, for example cementitious mortar, to provide an adjustable support 1 with high resistance to lateral shear forces from continuous traffic wheel impact loadings.

The adjustable support 1 is shown in FIG. 1. The adjustable support 1 consists of a upper frame member 9 and lower frame member 5. Optionally there is mounted from the upper frame member 9 is a third member as an access hatch frame 2. The access frame hatch 2, at least in part, defines a third aperture 18. The access hatch frame 2 could also be a third member of some type as required for mounting off the upper frame member 9.

A hatch cover 19 at least in part closes or covers the third aperture 18. The access hatch frame 2 and hatch cover 19 may be any such product known in the art or as required as a third member to mount off the upper frame member 9 with the addition of adjustability of the upper frame member 9 as described below.

Alternatively the upper frame member 9 may define the third aperture 18 without any further frame and the hatch cover 19 may fit directly onto the upper frame member 9.

The resulting assembly of the adjustable support 1 (being the lower frame member 5 and upper frame member 9) access hatch frame 2 (if present) and hatch cover 19 is typically mounted to at least in part, close the opening 36 to a sub-surface chamber or the like 4.

The adjustable support 1 will now be described in more detail.

One part of the adjustable support 1 is the lower frame member 5. This, at least in part, defines a first aperture 6 having a major plane or first plane 7 shown in FIG. 2. In the preferred embodiment, the lower frame member 5 is an endless member defining the first aperture 6. However in other embodiments the lower frame member could be interrupted, open or only partially define the first aperture 6. On an upper surface of the lower frame member 5 is an upper interface surface 8 (also referred to as an angled upper surface). This surface or combination of surfaces is parallel to, or defines, at least in part, a planar interface or angled contact zone 14 that lies on an interface plane 15 (shown in FIG. 2).

In the preferred embodiment, the upper interface surfaces 8 are characterised by a fourth skirt 33 that depends upwardly from the lower frame member 5. In the preferred embodiment, this fourth skirt 33 is tapered as shown in FIG. 1 and is substantially circular when viewed on the interface plane 15.

Figure 2:
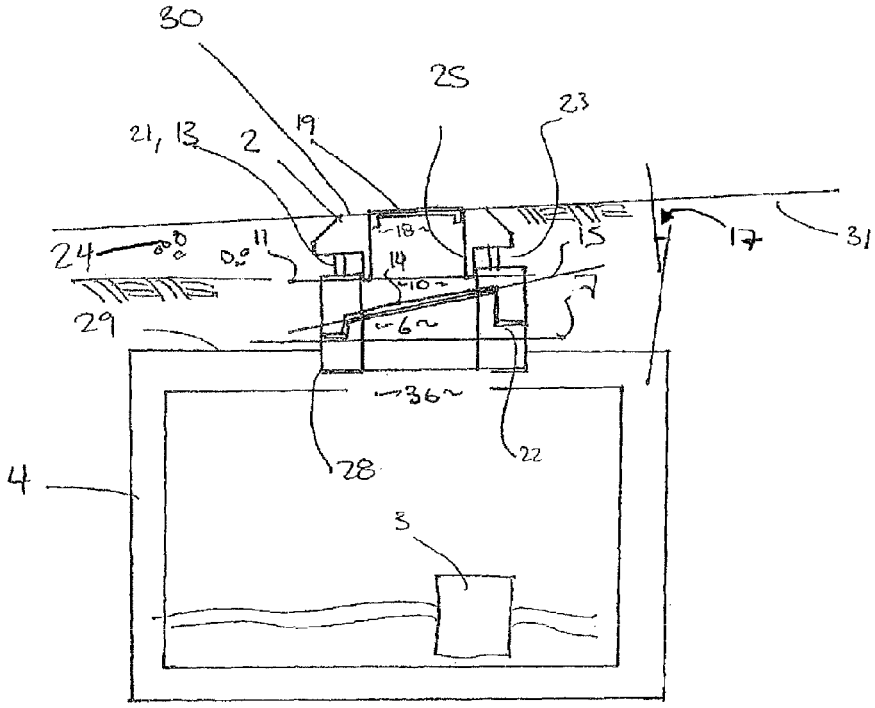
FIG. 2: is a cross-sectional view in the vertical plane of the assembly of FIG. 1 when mounted to a sub-surface chamber showing the resultant assembly tying below the surface, such chamber used for example for access to power, telecommunications, or similar utilities.

The upper frame member 9 also defines a second aperture 10 and therefore also a second plane 11 as shown in FIG. 2. In the preferred embodiment, the upper frame member 9 is an endless member defining the second aperture 10. However in other embodiments the upper frame member 9 could be interrupted, open or only partially define the second aperture 10. The first plane 7 and second plane 11 may, or may not, be parallel to one another as will be described below.

The upper frame member 9 similarly has at least one lower interface or surfaces 12 from which depends a third skirt 32. In the preferred embodiment, the third skirt 32 is complimentary to the fourth skirt 33 and, as shown in the embodiment in FIGS. 1 and 2, the third skirt 32 sits outside the fourth skirt 33. Similar to the fourth skirt 33, the third skirt 32 is tapered 27 to engage therewith. This arrangement is advantageous as the fourth skirt 33 provides a raised dam than prevent ingress of materials from the outside of the support across the interface of the upper frame member 5 and lower frame member 6.

Figure 8:
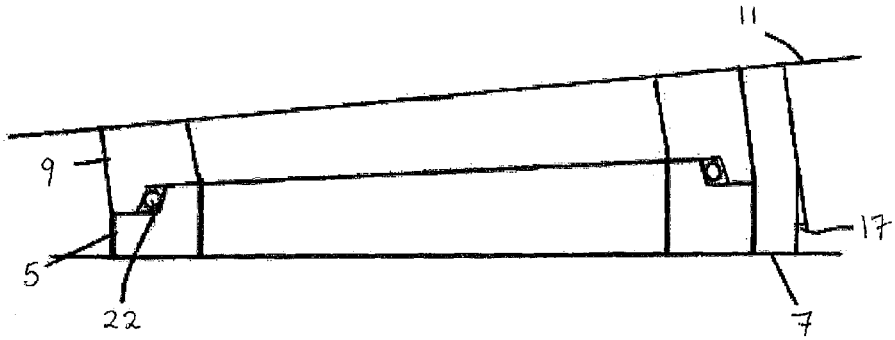

In the preferred embodiment the taper 27 leaves sufficient room for a setting or locking compound 22 between the interface surfaces of the upper frame, member 9 and lower frame member 5 as shown in FIG. 8. The kicking compound may be a cementitlous compound, mortar or other similar chemically setting compound, or may be a mastic or similar adhesive whether it sets hard or remains elastic. Such jointing compounds are known in the art. In yet other embodiments the locking of the upper frame member 9 to the lower frame member 5 may be mechanical such as by bolts or similar that pass at least in part into, or through, each frame member 5 and 9. These may be permanent or removable to allow subsequent adjustment.

In other forms of the present invention, the concentric arrangement of the skirt may be reversed such that the fourth skirt 33 equivalent would sit outside the third skirt 32 equivalent. The two skirts 33 and 34 act to form a spigot and socket to act as a shear key that still allows the relative rotation 16 desired until they are locked in place.

Again in a preferred embodiment, the lower interface surface or surfaces 12 of the upper frame member 9, at least where they are complimentary and engage with the mating surfaces of the lower frame member 5 are circular, at least when viewed on the interface plane 15.

As can be seen, the interface plane 15 is not parallel to either of the second planes 11 or first plane 7.

The result is that rotation or relative rotation 16 of the rower frame member 5 to the upper frame member 9 will result in the change of angle of the first plane 7 relative to the second plane 11.

An example of the result of this is shown in FIG. 8 where relative rotation of the upper frame member 9 and the and lower frame member 5 results in a relative angle 17. The significance of this will be explained further below.

Depending from the upper frame member 9 and, preferably upwards therefrom, and from an upper surface thereof, there are a plurality of height adjustable mount points 13. In the preferred embodiment, these are infinitely adjustable over their height range, and may, for example, be threaded rods or bolts as adjustable members 21, shown for example in FIG. 4 that engage either down into the upper frame member 9 or into complimentary apertures as height adjustable mount points 13, similar points may be present in the access hatch frame 2. In yet other embodiments, the adjustable members 21 may be step-wise adjustable with notches or similar at given height increments.

Figure 4:
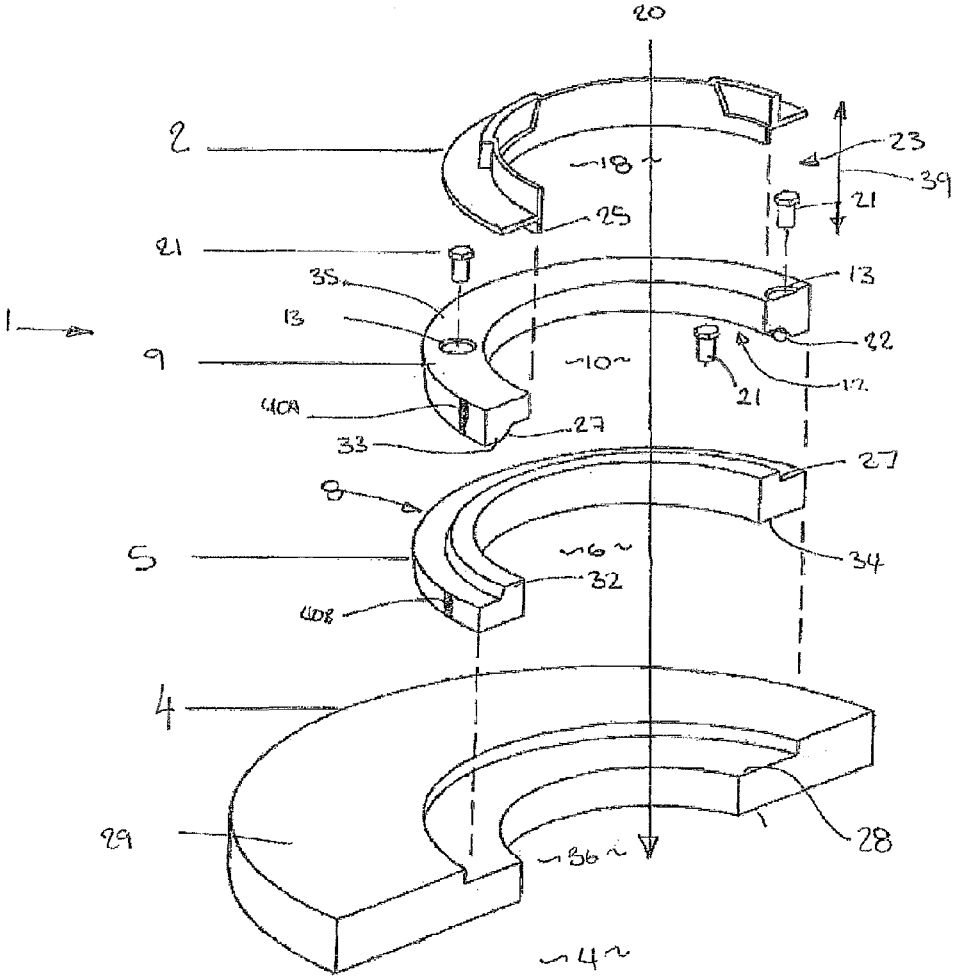
Figure 5:
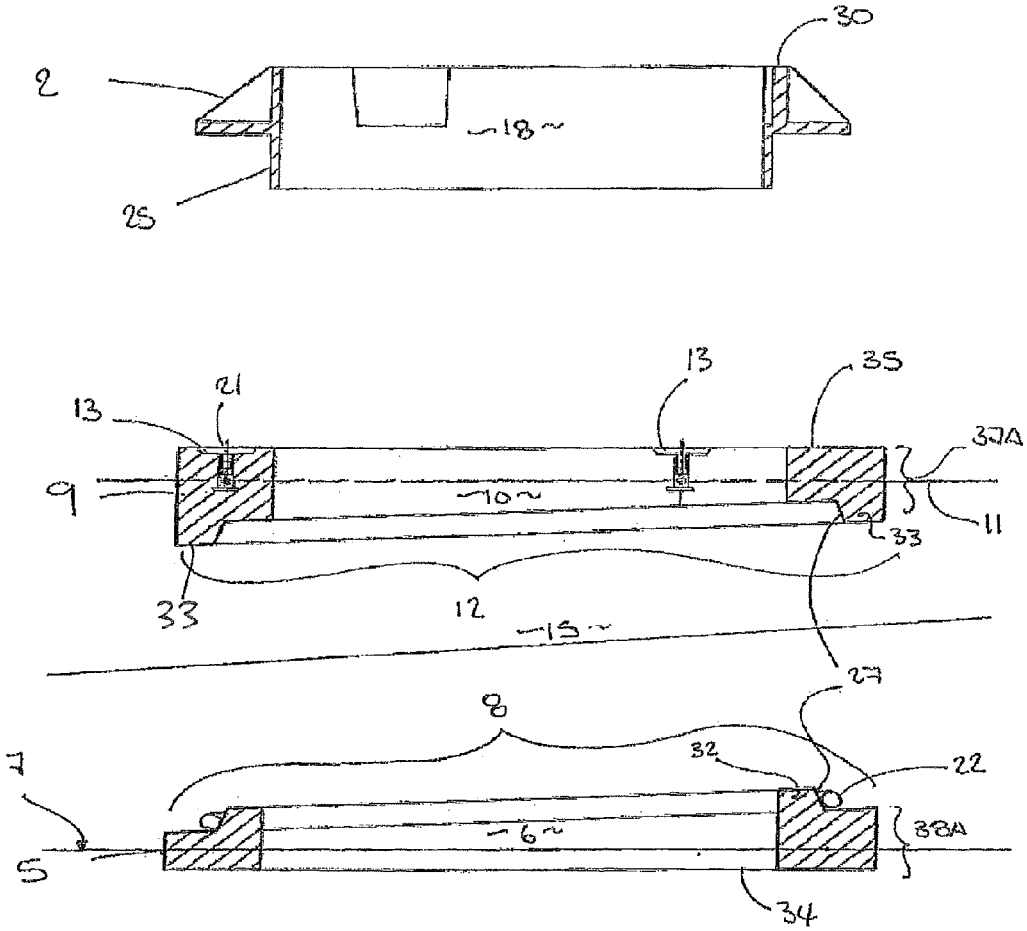

In a preferred embodiment, the first skirt 25 depends downwardly from a lower surface of the access hatch frame 2, at least to the desired maximum height of adjustability the height adjustable mount points 13 can provide as shown in FIGS. 4 and 5. This, in effect, will cover any gap 23 that would otherwise be present between the access hatch frame 2 and the upper mounting surfaces 35 of the upper frame member 9. Alternatively, a second skirt (not shown) may depend from the upper frame member 9. In yet other embodiments, the first skirt 25 may downwardly depend from the access hatch frame 2 and a second skirt 28 may upwardly depend from the upper frame member and the first skirt 25 and second skirt 26 may overlap. In yet other versions of the present invention, the surrounding fill 24 may close the gap 23, for example, when during construction that gap is shuttered off to allow, for example, setting of the fill material. Subsequently, any shuttering present may be removed and the gap is therefore dosed.

The resulting assembly allows adjustment of height 39 of the uppermost surface 30 of the access hatch frame 2 and/or hatch cover 19 and adjustment of relative angle 17 to the sub-surface chamber 4 or the like from which the access hatch frame 2 and/or hatch cover 19 is mounted from via the adjustable support 1. This in turn allows for rapid onsite adjustment for variations in height and/or cross fall of the ground surface 31 relative to the sub-surface chamber 4 or the like. This facilitates rapid adjustment that can be achieved, even up to, and including as the ground surface 31 is filed or applied in and around the sub-surface chamber 4 or the like. This also allows for subsequent adjustment to be made, for example, during resurfacing or re-sealing where either more height is added, the cross-fall is changed, or height is removed.

In the preferred embodiment, the sub-surface chamber 4 has a sub-surface upper surface 29 that has a mating recess 28 that receives, at least in part, a lowermost surface of the lower frame member 5.

In other embodiments, there may be locking between the sub-surface chamber 4 or the like and the lower frame member 5 to allow easier relative rotation 16 of the upper frame member 9 to the lower frame member 5. In the preferred embodiment, the relative rotation 16 is infinitely adjustable and not stepwise.

In other embodiments, there may be multiple adjustable supports 1, one stacked on top of each other. This conveys the advantage of allowing a more offset access passage 20 to the sub-surface chamber 4 or the like.

Figure 6:
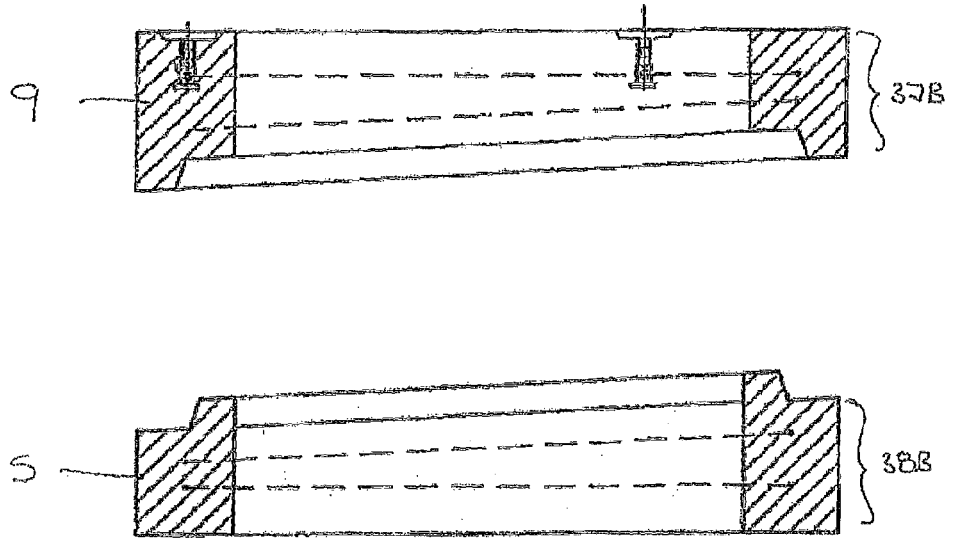
FIG. 6: is a variation of height set of FIG. 5, FIG. 7: is a cross-sectional view of a further height upper frame member of FIGS. 5 and 8, and FIG. 8: shows the adjustable support of the present invention with relative rotation of the upper frame member and the lower frame member to achieve a relative angle of the two.
Figure 7:
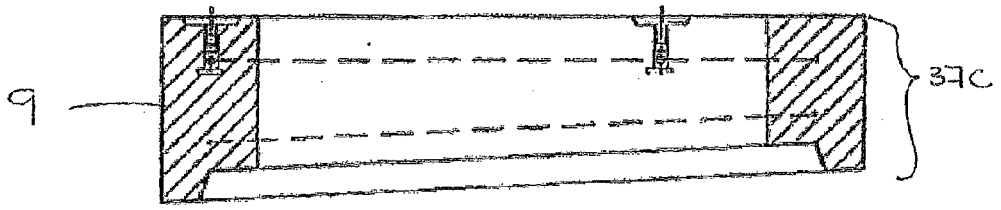

Shown in FIGS. 5, 6 and 7 are upper frame members 9 of varying thickness 37A, B and C. Likewise the lower frame member 5 can be of varying thickness 38A and B also. This allows for flexibility in setup of the adjustable support 1. For example when the ground surface 31 is close to the sub-surface chamber upper surface 29 a thinner adjustable support 1 may be desirable, such as shown in FIG. 5. As the grounds surface 31 is further away from the sub-surface chamber upper surface 29 then increasingly thicker adjustable supports 1 may be desirable as shown in FIG. 6 and partially in 7. This allows mixing and matching to form the right height of adjustable support 1, and allows the ability to change the height post installation, for example when the ground surface 31 is re-set. IN other embodiments there may be an extension (not shown) between the subsurface chamber 4 and the support 1, or between the support 1 and the hatch 19 or similar.

Figure 3:
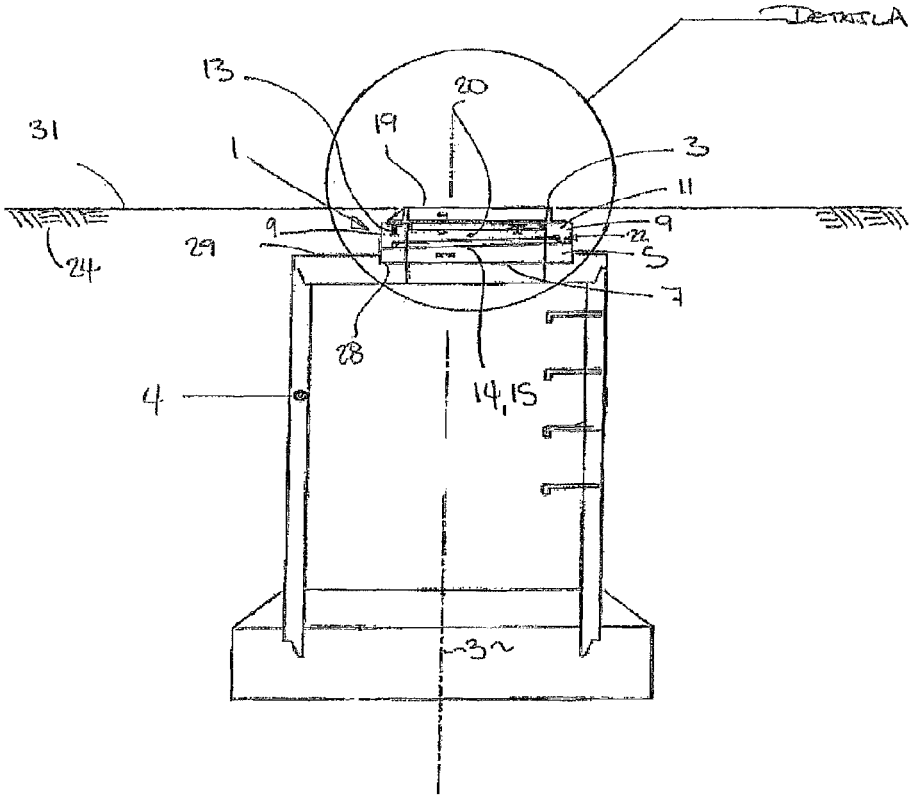
FIG. 3: is a vertical cross section through a sub-surface chamber of a type that for example is used to access storm water, sewage or the like, FIG. 4: is an exploded isometric cross-section on a vertical cutting plane of FIG. 1, FIG. 5: is a further view of the cross-section of Detail A of FIG. 3 showing one height set of upper frame member and lower frame member.

Within the sub-surface chamber 4 or the like, a utility 3 is located. Such utility could be electrical, telecommunications, gas, water, sewerage, or other such utilities such as shown in FIGS. 2 and 3. The surrounding of at least the adjustable support 1 is being covered in fill 24 and any subsequent paving or surface treatments to then create the desired ground surface 31. If subsequent height and/or angle adjustment is required, the multiple height adjustable mount points are then used to vary the height either up or down and if the setting compound 22 can be broken, or other anchoring removed, then relative rotation 16 of the upper frame member 9 and lower frame member 6 can then adjust the relative angle 17 as desired.

When installing the adjustable support 1 the sub-surface chamber 1 or the like may be present, or the adjustable support 1 can be located into the desired position and height it will have if the subsurface chamber were present. The adjustable support 1 is located either at zero relative angle, or is set to the desired relative angle 17. This can be done prior to location or in situ. To indicate zero relative angle there are indicia 40A and 40B on the outer periphery of the upper frame member 9 and the lower frame member 5 respectively as shown in FIG. 4. These index the zero relative angle. Then relative rotation 16 once done to achieve the desired relative angle 17 is then marked by chalk or similar on the outer periphery of the upper frame member 9 and lower frame member 5 to act as a key.

The third member or access hatch frame 2 is then located at the desired height as described. The resulting assembly can then be left in place and filled around, or can be removed, final finishing completed and then re-located, the chalk marks (or the like) realigned and installation completed. There may also be additional indicia to mark certain angles, for example to give a relative angle 17 of 1 degree, 2 degrees, 2.5 degrees and so on.

The invention has the benefit of straightforward height and angle adjustment without the need for the use of blocks, wedges and packers, that otherwise require a high degree of workmanship and skill. The present invention enables the use of largely off the shelf components. The invention has ease of setup and adjustment on site so that hatch covers 19 can be set exactly to match a pavement's surface 31 grade/height and crossfall. The height of the uppermost surface 30 can be easily readjusted if required because of changes in pavement surface 31 levels resulting from subsequent resurfacing and pavement or reconstruction. The present invention can be installed in shorter installation time, and hence reduce labour costs, requires lower skill level to install, can be retro-fitted to existing manholes, eliminates or reduces problematic vibration complaints from adjacent property owners, gives improved ride, and improved aesthetics.

The foregoing description of the invention includes preferred forms thereof. Modifications may be made thereto without departing from the scope of the invention.

What I claim is:

1. An adjustable support adapted to support an access hatch frame for access to a sub-surface chamber, comprising:

a lower frame member that at least in part defines a first aperture, said first aperture having or defining a first plane, said lower frame member having at least one upper interface surface;

an upper frame member that at least in part defines a second aperture, said second aperture also having or defining a second plane, said upper frame member also having at least one lower interface surface, and a plurality of height adjustable mount points; and wherein said at least one upper interface surface and said at least one lower interface surface define a planar interface, located on or parallel to an interface plane, said interface plane not being parallel to either of said first or second planes, wherein said lower interface surface and said upper interface surface are bevelled to aid engagement thereof, such that rotation of said upper frame member relative to said lower frame member about or on said planar interface varies the relative angle of said first plane to said second plane, said relative rotation and said height adjustable mount points allowing adjustment of said relative angle and height, relative to said upper frame member and said lower frame member, of a third member adapted to be mounted from said upper frame member via said plurality of height adjustable mount points.

2. A frame as claimed in claim 1 wherein said third member is an access hatch frame that at least in part defines a third aperture.

3. A frame as claimed in claim 2 wherein said access hatch frame is adapted to receive a hatch cover that at least part covers said third aperture.

4. A frame as claimed in claim 2 wherein said upper frame member, lower frame member, and access hatch frame via said first aperture, second aperture and third aperture define an access passage to said sub-surface chamber or the like when mounted thereto and said hatch cover at least in part closes off said access passage.

5. A frame as claimed in claim 2 wherein said sub-surface chamber is substantially sealed from access by said adjustable support, access hatch frame and said hatch cover.

6. A frame as claimed in claim 1 wherein said plurality of height adjustable mount points are adjustable members that extend from said upper frame member to said access hatch frame.

7. A frame as claimed in claim 6 wherein said adjustable members are infinitely adjustable over the height they mount said access hatch frame from said upper frame member.

8. A frame as claimed in claim 6 wherein said adjustable members are step-wise adjustable over the height they mount said access hatch frame from said upper frame member.

9. A frame as claimed in claim 6 wherein said adjustable members are threaded adjustable members.

10. A frame as claimed in claim 6 wherein said adjustable members are stepped adjustable members.

11. A frame as claimed in claim 1, wherein the lower frame element and upper frame element are concrete elements.

12. A method of installing an adjustable support for an access hatch frame for a sub-surface chamber, comprising the steps of:

i. Locating a lower frame member onto a sub-surface chamber, said lower frame member at least in part defining a first aperture, said first aperture having or defining a first plane, said lower frame member having at least one upper interface surface, ii. Locating an upper frame member via at least one lower interface surface thereof onto said at least one upper interface surface, said upper frame member at least in part defining a second aperture, said second aperture also having or defining a second plane, said at least one upper interface surface and said at least one lower interface surface defining a planar interface, located on or parallel to an interface plane, said interface plane not being parallel to either of said first or second planes, wherein said lower interface surface and said upper interface surface are bevelled to aid engagement thereof, iii. Rotating said upper frame member relative to said lower frame member on said interface plane as necessary to adjust the relative angle of said upper frame member to said lower frame member, iv. Marking the relative positions of said upper frame member to said lower frame member via an indicia or indices on one of both of said upper frame member and said lower frame member, v. Mounting a third member off said upper frame member via a plurality of height adjustable mounts between said third member and said upper frame member to thereby provide said third member with adjustable relative angle and height from said sub-surface chamber to match a surface angle and height below which said sub-surface chamber is, or is to be, located.

13. A method as claimed in claim 12, further comprising:

removing said upper frame member, lower frame member, and third member, preparing said sub-surface chamber or surrounding ground, and relocating in situ on said sub-surface chamber of said upper frame member, lower frame member, and third member.

14. A method as claimed in claim 12 wherein a locking compound is located between said upper frame member and said lower frame member.

15. A method as claimed in claim 12 wherein said third member is an access hatch frame.

16. A method as claimed in claim 12 wherein fill is located about said upper frame member, lower frame member and said third member to produce said surface below which said sub-surface chamber is located.

17. A kit of parts to provide an adjustable support for an access hatch frame for a sub-surface chamber, comprising:

an adjustable support comprising:

i. a lower frame member that at least in part defines a first aperture, said first aperture having or defining a first plane, said lower frame member having at least one upper interface surface;

ii. an upper frame member that at least in part defines a second aperture, said second aperture also having or defining a second plane, said upper frame member also having at least one lower interface surface, and a plurality of height adjustable mount points; and iii. wherein said at least one upper interface surface and said at least one lower interface surface define a planar interface, located on or parallel to an interface plane, said interface plane not being parallel to either of said first or second planes, wherein said lower interface surface and said upper interface surface are bevelled to aid engagement thereof, such that rotation of said upper frame member relative to said lower frame member about or on said planar interface varies the relative angle of said first plane to said second plane, said relative rotation and said height adjustable mount points allowing adjustment of said relative angle and height, relative to said upper frame member and said second frame member, of a third member adapted to be mounted from said upper frame member via said plurality of height adjustable mount points.

18. A kit as claimed in claim 17 wherein there is included an access hatch frame as said third member.

19. A kit as claimed in claim 17 wherein there is included a hatch cover to at least in part close said access hatch frame.

20. A kit as claimed in claim 17 including a locking material to lock said upper frame member to said lower frame member.

* * * * *

UNITED STATES PATENT AND TRADEMARK OFFICE

CERTIFICATE OF CORRECTION

PATENT NO. : 8,870,490 B2
APPLICATION NO. : 13/983427
DATED : October 28, 2014
INVENTOR(S) : Neil Gumbley It is certified that error appears in the above-identified patent and that said Letters Patent is hereby corrected as shown below:

In the Claims

In Column 12, lines 45 - 50, claim 4 should read: --A frame as claimed in claim 2 wherein said upper frame member, lower frame member, and access hatch frame via said first aperture, second aperture and third aperture define an access passage to said sub-surface chamber when mounted thereto and said hatch cover at least in part closes off said access passage.--

Signed and Sealed this
Tenth Day of February, 2015

Michelle K. Lee

Michelle K. Lee
*Deputy Director of the United States Patent and Trademark Office*